United States Patent [19]

Lubitz et al.

[11] Patent Number: 4,718,495

[45] Date of Patent: Jan. 12, 1988

[54] SURFACE PACKER AND METHOD FOR USING THE SAME

[75] Inventors: Eric P. Lubitz; David D. Szarka; Ernest E. Carter, Jr.; Robert L. Jessup, all of Duncan, Okla.

[73] Assignee: Halliburton Company, Duncan, Okla.

[21] Appl. No.: 861,767

[22] Filed: May 8, 1986

[51] Int. Cl.[4] ..... E21B 33/03

[52] U.S. Cl. ..... 166/387; 166/67; 166/120; 251/1.2

[58] Field of Search ..... 166/67, 77.5, 82, 84, 166/86, 88, 118, 285, 120, 121, 187, 382, 387, 116; 251/1.2; 277/34; 285/139, 140, 144, 146, 147

[56] References Cited

U.S. PATENT DOCUMENTS

| | | | |
|---|---|---|---|
| Re. 30,110 | 10/1979 | Huebsch et al. . | |
| 2,313,169 | 3/1943 | Penick et al. | 166/75.1 |
| 2,843,349 | 7/1958 | Meyer | 251/1.2 |
| 3,288,219 | 11/1966 | Young et al. | 166/120 |
| 3,323,773 | 6/1967 | Walker . | |
| 3,503,445 | 3/1970 | Cochrum . | |
| 3,556,220 | 1/1971 | Schwegman . | |
| 3,734,139 | 6/1973 | Watts | 251/1.2 |
| 3,768,562 | 10/1973 | Baker . | |
| 3,948,322 | 4/1976 | Baker . | |
| 3,952,799 | 4/1976 | Simpson | 166/187 X |
| 4,071,085 | 1/1978 | Grable et al. | 166/84 |
| 4,105,069 | 8/1978 | Baker . | |
| 4,192,376 | 3/1980 | Lissmyr . | |
| 4,253,676 | 3/1981 | Baker et al. . | |
| 4,286,658 | 9/1981 | Baker et al. . | |
| 4,310,139 | 1/1982 | Williams et al. | 251/1.2 |
| 4,310,161 | 1/1982 | Streich . | |
| 4,372,562 | 2/1983 | Carter, Jr. . | |
| 4,460,149 | 7/1984 | Shaeper et al. | 251/1.2 |
| 4,522,430 | 6/1985 | Stromberg . | |
| 4,524,998 | 6/1985 | Brisco . | |
| 4,546,828 | 10/1985 | Roche | 166/84 |

OTHER PUBLICATIONS

Composite Catalog p. 1254 by Rector Well Equipment Co., 1984.

Composite Catalog p. 4224 by Regan Forge & Engineering Co., 1984.

Composite Catalog p. 1452 by Cameron Iron Works, Inc., 1984.

*Primary Examiner*—Stephen J. Novosad
*Assistant Examiner*—David J. Bagnell
*Attorney, Agent, or Firm*—James R. Duzan

[57] ABSTRACT

Surface packer and method for using the same. An annular body is mounted on the upper end of a string of casing which extends above a drilling rig platform. An annular seal is received within the body at the upper end thereof and may be sealed against the radially outer surface of a string of drill pipe which is lowered therethrough into the casing. A radial circulation port is formed in the body beneath the annular seal. In a cementing operation, a string of drill pipe is lowered in the casing to the lower end thereof and the annular seal is sealed thereagainst. The pipe-casing annulus is pressurized and cement is pumped into the drill pipe for cementing the casing into the well bore. In one embodiment, the annular seal is of the inflatable type which permits vertical and rotational manipulation of the pipe string while maintaining the seal thereagainst.

42 Claims, 13 Drawing Figures

SURFACE PACKER AND METHOD FOR USING THE SAME

BACKGROUND OF THE INVENTION

1. Field of the Invention

The instant invention pertains generally to tools for packing off the annulus between a well casing and a string of pipe received therein and more particularly to such tools which are adapted to be used at the surface of the well.

2. Setting of the Invention

In the usual well cementing operation, casing is lowered into the well bore and thereafter cement is pumped into the casing, through the bottom, and upwardly into the annulus between the casing and the bore. Thereafter pumping pressure is released and the cement is permitted to set.

Sometimes, usually when cementing large diameter casing, a string of drill pipe or tubing is run to the bottom of the casing and cement is pumped through the inner string and into the annulus between the casing and the well bore at the bottom of the well. When using especially large casing and/or when placing a surface string of casing at an extreme depth, it may be necessary to pack off the annulus between the inner string and the casing at the upper end thereof during cementing. This prevents the inward collapse of the casing in response to cement under pressure being pumped into the annulus between the casing and the well bore. Such a pack off also helps to overcome hydraulic forces acting to lift the drill pipe out of position and permits testing the casing for leaks prior to placing cement slurry.

The present invention provides a surface packer and method for using the same in connection with inner string cementing operations. The method and apparatus of the instant invention can be used for other operations such as low to moderate pressure squeeze cementing work behind the surface casing and for spotting and squeezing lost circulation fluids to combat lost circulation zones encountered before a blowout preventer is installed on the wellhead. More generally, the method and apparatus of the invention may be used to seal the upper end of a string of casing whenever required, e.g., for controlling well pressures prior to installation of a blowout preventer.

The apparatus of the instant invention includes an annular body having a lower end adapted for sealing connection to the upper end of a well casing. A packer of the type which may be fluidically set is mounted on the radially inner surface of the annular body and a slip bowl is mounted on the body over the packer. In using the instant invention, the body is mounted on the upper end of a string of casing and a string of pipe is lowered therein through the body. Thereafter, cementing or other operations may be performed while the annulus between the pipe and the casing is maintained under pressure. In one aspect of the invention, the packer is of the inflatable type for permitting inner string manipulation while maintaining the seal between the inner string and the casing. In another aspect of the invention, the body is adapted for quick connection to the upper end of the casing string.

Numerous objects, features and advantages of the present invention will be readily apparent to those skilled in the art upon a reading of the following disclosure when taken in conjunction with the accompanying drawings, wherein:

FIG. 6 is a cross-sectional view taken along lines 6—6 in FIG. 5.

DETAILED DESCRIPTION OF THE PREFERRED EMBODIMENTS OF THE METHOD AND APPARATUS OF THE INVENTION

Figure 1:
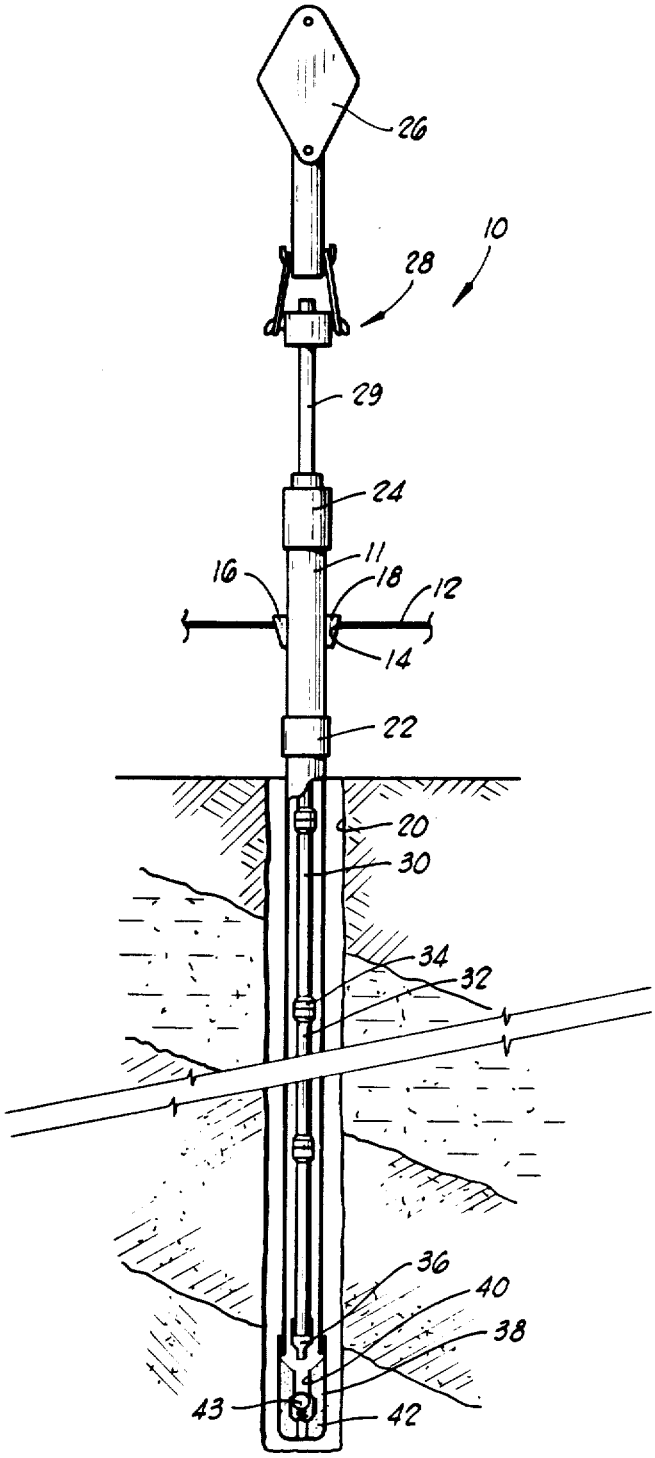
FIG. 1 is a somewhat schematic, partially cross-sectional view of a tool incorporating the instant invention mounted on the upper end of a string of casing preparatory to cementing the casing.

Indicated generally at 10 in FIG. 1 is a drilling rig, only selected components of which are shown for the sake of clarity. A string of casing 11 is suspended from a drilling rig platform 12 through an opening 14 therein. A conventional set of slips 16, 18 are received in opening 14 to suspend casing 11 from the platform.

The casing extends downwardly into a well bore 20. Casing string 11 is made up of a plurality of individual pieces of casing which are connected via casing collars, the only one shown in the drawing being casing collar 22. Casing collar 22 includes a set of female threads on each end thereof. Each piece of casing includes a set of male threads on each end thereof. The female threads on each end of the casing collars are threadably engaged with a set of male threads on the casing thereby forming a continuous casing string.

A surface packer 24, constructed in accordance with the invention, is mounted on the upper end of casing string 11. Surface packer 24 and three other embodiments of a surface packer constructed in accordance with the instant invention will be hereinafter more fully described.

In addition to platform 12, drilling rig 10 includes the usual traveling block 26 suspended from line (not shown) which is rigged with a drilling mast (also not shown) in the usual fashion. A set of elevators 28 is suspended from the traveling block and, in the view of FIG. 1, firmly grip a string of drill pipe 29 which extends downwardly through surface packer 24 into casing string 11. Pipe string 29 is made up of a plurality of individual drill pipes, like pipes 30, 32 which are threadably engaged with one another at joints, like joint 34, between pipes 30, 32. The lower end of pipe string 29 includes a sealing adapter 36.

On the lower end of casing string 11 is a casing shoe 38. The casing shoe includes a sealing sleeve 40 which is molded in concrete 42 received within the shoe. A check valve 43 prevents fluid from entering the casing string as it is lowered in the well. As will later be described in more detail, adapter 36 may be sealingly received within sleeve 40, after which cement may be pumped into pipe string 29 for cementing the annulus between the casing string and the well bore.

Figure 2A:
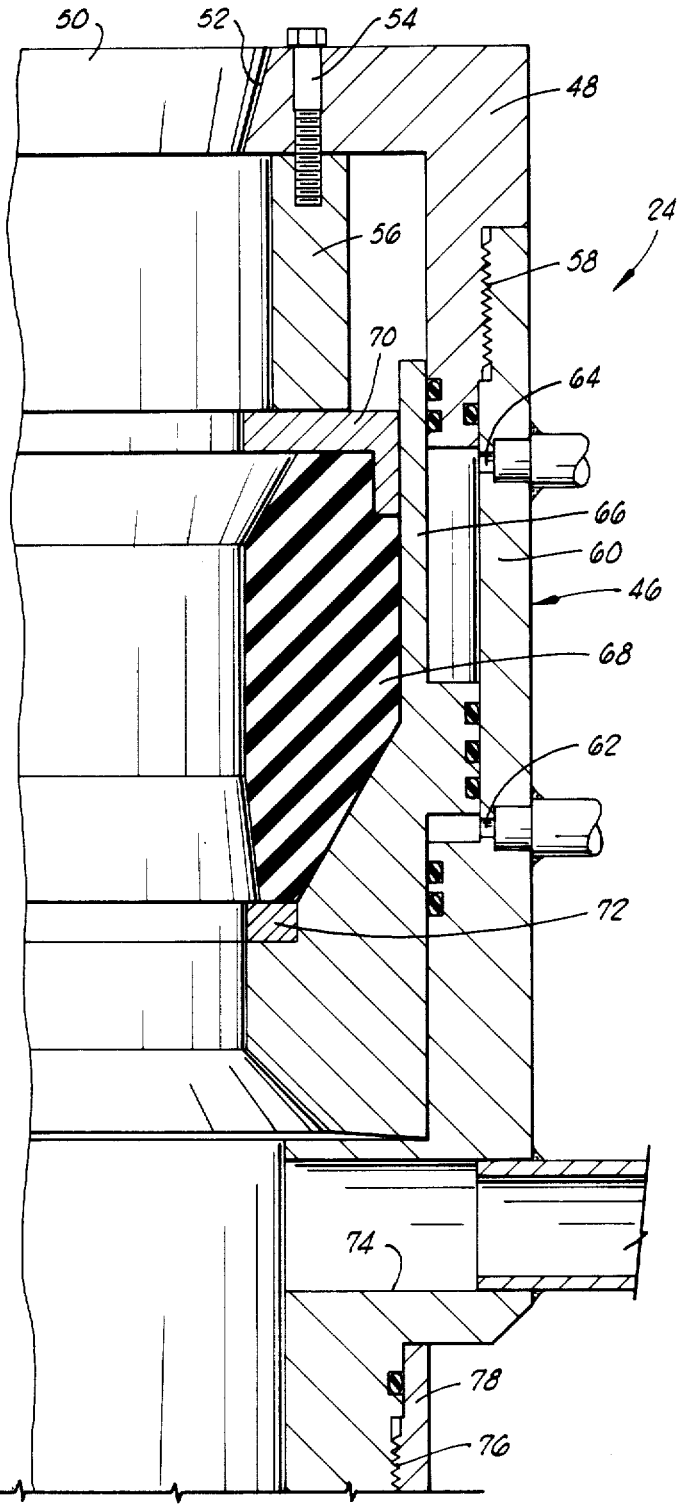
FIGS. 2A-2C are successive downward continuations of a cross-sectional view of the right portion of a first embodiment of a surface packer constructed in accordance with the instant invention.
Figure 2B:
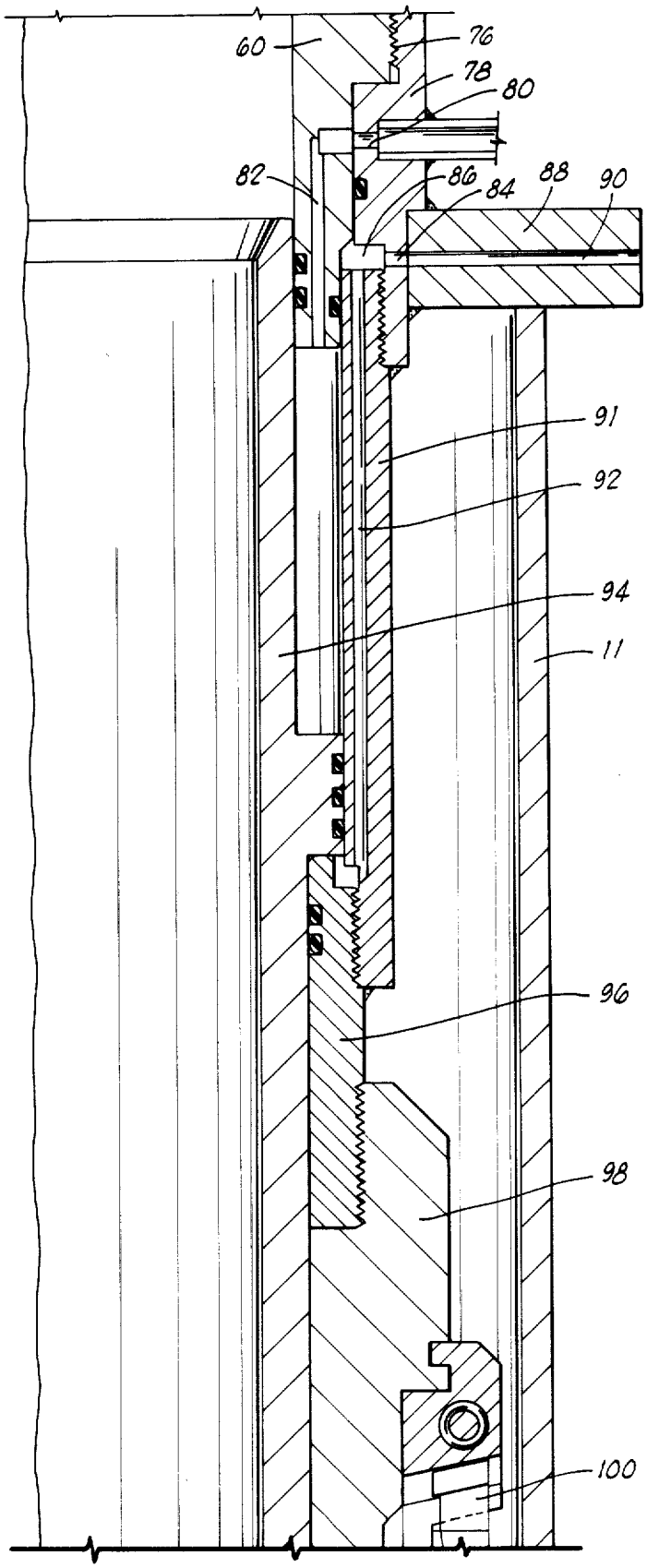
Figure 2C:
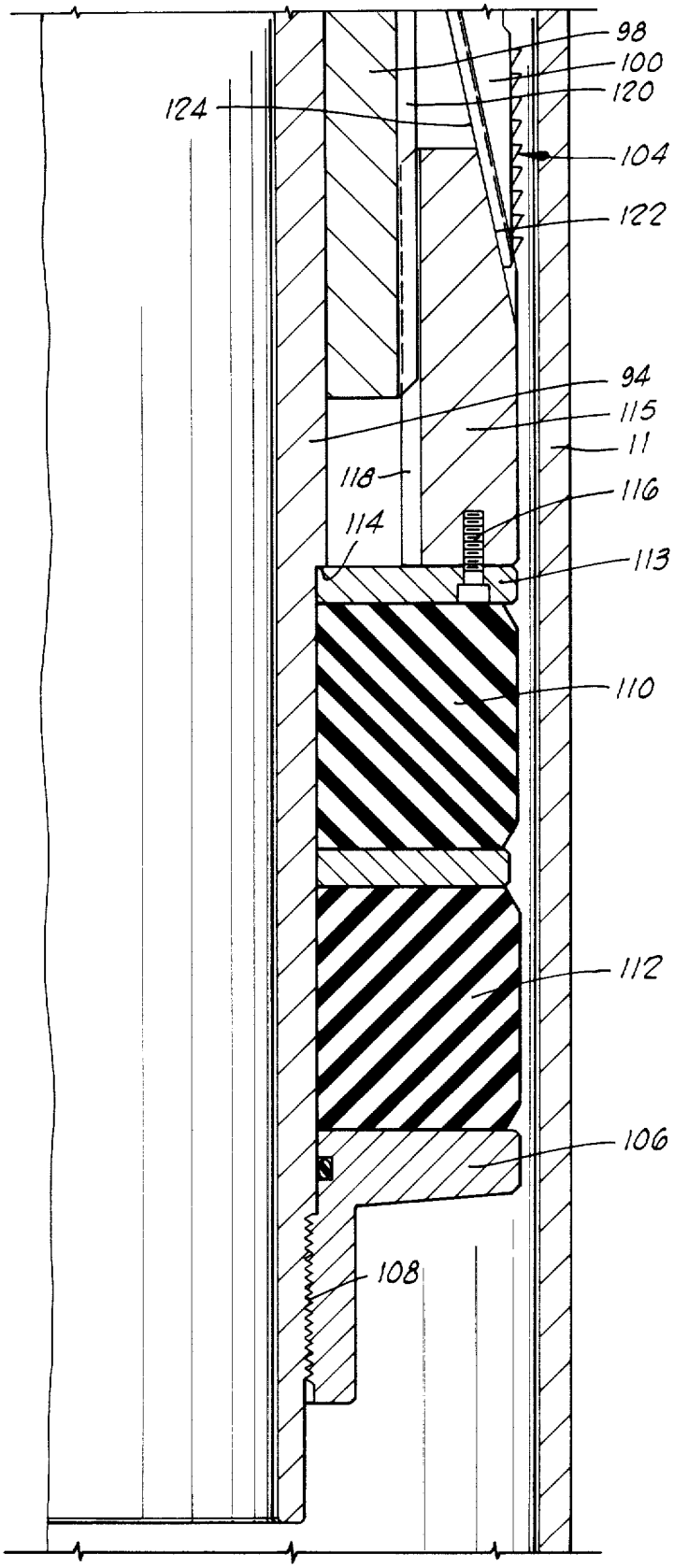

Embodiment of FIGS. 2A-2C

In FIGS. 2A-2C, surface packer 24 is shown received in the upper end of casing 11, shown in FIGS. 2B-2C; however, in the view of FIGS. 2A-2C, for the sake of clarity, drill pipe string 29 is not shown.

Surface packer 24 includes an elongate annular body 46 extending from the top to the bottom of the surface packer and through which pipe string 29 may be received. Included therein is an annular slip bowl 48. The slip bowl includes a central substantially circular opening 50 through which pipe string 29 may be received. A tapered surface 52 is formed about the circumference of the opening and cooperates with a set of conventional slips (not shown) for wedging the drill string in the opening and thereby supporting the same. A plurality of bolts, with only bolt 54 being visible, connect slip bowl 48 to a ring 56. Slip bowl 48 is connected, via threaded connection 58, to a substantially annular piston housing 60. The housing includes a packer element setting port 62 and a packer element releasing port 64. An annular piston 66 is slidingly and sealingly received within housing 60 and is urged upwardly when hydraulic fluid is introduced into port 62 and downwardly when fluid is introduced into port 64.

A substantially annular elastomeric packer element 68 is received within and supported by piston 66. An upper end ring 70 abuts against the upper end of the packer element while a lower end ring 72 abuts against the lower end thereof. End ring 70 is sandwiched between the packer element and ring 56. End ring 72 is immediately beneath the packer element and is supported on an upward facing shoulder formed on annular piston 66.

A port 74 formed in housing 60 provides fluid communication between the interior and exterior of the housing.

The lower end of housing 60 is engaged via threaded connection 76 with an annular connector 78. Connector 78 includes therethrough a first radial port 80 which is in fluid communication with a duct 82 formed in housing 60 and communicating with the lower end thereof. A second radial port 84 is formed through connector 78 and is in communication at its inner end with an annular space 86.

An annular flange 88 is closely received over the lower portion of connector 78 and abuts against a downward-facing shoulder formed on the radially outer surface of the connector. Flange 88 is welded via welds as shown to connector 78. The flange includes a radial bore 90 which provides fluid communication between the radially outer surface of the flange and port 84. The underside of flange 88 abuts against the uppermost end of casing string 11. Flange 88 thus supports surface packer 24 on the casing when the surface packer is first lowered therein.

A second annular piston housing 91 is threadably connected to the lower end of connector 78 and includes a duct 92 along a substantial portion of the length thereof which permits fluid communication between the upper end of housing 91 and the radially inner surface of the housing near the lower end thereof. A second piston 94 is slidingly and sealingly received within piston housing 91. It can be seen that when hydraulic fluid is injected via port 80, piston 94 is driven downwardly and that when such fluid is injected into port 90, the piston is driven upwardly.

The lower end of housing 91 is threadably engaged with an annular connector 96 which in turn is threadably engaged with an annular slip supporting member 98 which is closely received about the circumference of piston 94. A set of slips, one of which is slip 100, are loosely connected to slip supporting member 98 in a manner which permits radial movement of the slips. The slips are disposed about the circumference of supporting member 98 and each slip includes a plurality of pointed elements, indicated generally at 104 on slip 100, which, as will later be more fully explained, may engage the radially inner surface of casing 11 in order to anchor the surface packer in place.

In FIG. 2C, the lower end of piston 94 includes an annular lower packer shoe 106, such being threadably engaged with piston 94 via threaded connection 108. A pair of annular elastomeric packer elements 110, 112 are closely received about piston 94 and are supported by lower packer shoe 106. A ring 113 is received beneath a downward facing shoulder 114 formed on piston 94. A slip body 115 is bolted via a plurality of screws, with only screw 116 being visible, to ring 113. The slip body includes a first arcuate surface 118 which is abutted against an arcuate surface 120 on member 98 with surface 118 being longitudinally slidable along surface 120.

In a similar fashion, surface 122 formed on the radially outer surface of slip body 115 is slidable against surface 124 formed on the radially inner surface of slip 100. Thus, it can be seen that when piston 94 is urged upwardly, slip body 115 slides upwardly relative to slip supporting member 98 and slip 100 thereby urging slip 100, and each of the other slips, radially outwardly until the pointed elements, like elements 104, engage the radially inner surface of casing string 11 and thus anchor the surface packer thereto. Thereafter, further upward movement of piston 94 compresses packer elements 110, 112 between lower packer shoe 106 and ring 113 thereby deforming the packer elements into sealing engagement with the radially inner surface of the casing.

The description of the operation of surface packer 24 will be made in connection with a casing cementing operation, although it is to be appreciated that the surface packer is not necessarily limited for use in connection with cementing operations. With reference to FIG. 1, casing string 11, with casing shoe 38 at the lower end thereof, is made up and lowered into bore 20 in the usual fashion. When the casing string is lowered to substantially the lower end of the bore as shown in FIG. 1, slips 16, 18 are inserted into opening 14 in platform 12 in order to suspend casing string 11 from the platform as shown.

When the casing string is so suspended, surface packer 24 is lowered into the upper end thereof until flange 88 abuts against the uppermost portion of casing string 11 as shown in FIG. 2B. The flange prevents further lowering of the tool into the casing string and supports the tool in the position of FIGS. 2A-2C.

Then, hydraulic fluid under pressure is introduced to bore 90. The fluid passes through port 84, annular space 86, and duct 92 and is provided to the interior of annular piston housing 91 beneath the point at which piston 94 sealingly engages the radially inner surface of the housing. Piston 94 is thus urged upwardly.

Such upward movement urges lower packer shoe 106, in FIG. 2C, packer elements 110, 112, and slip body 115 upwardly thereby urging the slips, like slip 100, radially outwardly. Such upward movement continues until the slips engage the radially inner surface of casing string 11 thereby preventing further upward movement of slip body 115. As hydraulic fluid is further injected into bore 90, piston 94 continues its upward movement. Since slip body 115, and therefore ring 113, cannot move further upwardly, packing elements 110, 112 are compressed between shoe 106 and ring 113 thereby deforming the same into sealing engagement with the radially inner surface of casing string 11.

After the packing elements are sealed in the casing as described above, drill pipe string 29, in FIG. 1, is made up with adapter 36 on the lower end thereof and is lowered into casing string 11 through surface packer 24. In the lowering process, the upper end of the pipe string is releasably gripped by elevators 28 as shown in FIG. 1. Thereafter, a set of slips (not shown) is lowered into opening 50, in FIG. 2A, at the upper end of packer 24 to suspend pipe string 29 therefrom. Then, elevators 28 are released from the upper end of the pipe string and another pipe is threadably connected to the uppermost pipe in the string. Then, elevators 28 are releasably attached to the new pipe at the uppermost end thereof, the slips in opening 50 are removed, and traveling block 26 is lowered thereby lowering string 29 further into the casing. The slips in opening 50 are again set, elevators 28 are removed, and yet another pipe is threadably connected to the uppermost end of the pipe string. Elevators 28 are attached to the upper end of the newest pipe and the string is again lowered. This process is repeated until the pipe string is substantially lowered within the casing as shown in FIG. 1.

Drill string 29 is next lowered until adapter 36 is received within sealing sleeve 40. Thereafter, pressurized hydraulic fluid is introduced into port 62, in FIG. 2A, thereby urging piston 66 upwardly and compressing packer element 68 between the piston and end ring 70. Such compression deforms packing element 68 into sealing engagement with pipe string 29.

Thereafter, pressurized fluid is injected via port 74 into the annulus between pipe string 29 and the casing to maintain the same under pressure. Cement slurry is then pumped into pipe string 29 at the upper end thereof. The slurry passes downwardly through check valve 43 and into the annulus between the casing and bore 20. Once the casing-bore annulus is filled with cement, the pipe string is lifted to permit fluid communication between the lower end of the pipe string and the interior of the casing. Then, the upper end of the pipe string is connected to a return line and fluid is injected into port 74 to reverse circulate cement from the drill pipe. When the cement is circulated from the drill pipe, hydraulic fluid is introduced into port 64, in FIG. 2A, thereby releasing packing element 68.

Next, drill string 29 is removed from the casing by essentially reversing the steps by which it was lowered into the casing, as follows. Traveling block 26 raises drill string 29 until the uppermost drill pipe is above packer 24. Thereafter, the slips (not shown) are placed in opening 50 thereby supporting the pipe string from the packer and the uppermost drill pipe is unthreaded. Elevators 28 are attached to the uppermost pipe in the pipe string, the slips are removed, and the string is again raised until an additional length of pipe is above packer 24. This process is continued until the drill pipe string, including adapter 36 at the lower end thereof, is removed from the casing.

Hydraulic fluid is then introduced into port 80, in FIG. 2B, thereby urging piston 94 downwardly and releasing the slips and packing elements 110, 112. Packer 24 is then in the configuration of FIGS. 2A–2C and may be removed from the uppermost end of the drill string. Thereafter, the upper end of casing string 11 is cut off at the surface and a conventional blowout preventer may be mounted beneath platform 12 and additional drilling or other operations may continue.

Packer 24 may be adapted for different-sized casing by changing lower packer shoe 106, packing elements 110, 112, and slip body 115 to accomodate casing strings of varying diameters. Also, different sizes of packing element 68 and end rings 70, 72, in FIG. 2A, may be used in packer 24 to accomodate different diameters of drill pipe.

If necessary or desirable, drill string 29 may be lowered into casing string 11 prior to mounting tool 24 thereon. If this method is performed, a u-shaped plate is placed on top of the casing string to provide structure for supporting the pipe string slips during lowering of the pipe string. Once adapter 36 is received within sealing sleeve 40, packer 24 may be slipped over the last pipe to be connected to the pipe string prior to threading the pipe to the uppermost end of the string. After the pipe is so threaded and the pipe string is supported by the elevators, the u-shaped plate and slips may be removed and packer 24 lowered into the casing string and set as described above.

Embodiment of FIGS. 3A–3E

Indicated generally at 126 is a second embodiment of a surface packer constructed in accordance with the instant invention. Surface packer 126 is shown received in the upper end of casing 11, in FIGS. 3B–3E, in the same configuration as surface packer 24 in FIG. 1; however, in the view of FIGS. 3A–3E, for the sake of clarity, drill pipe string 29 is not shown.

Surface packer 126 includes an elongate annular body 128 extending from the top to the bottom of the surface packer and through which drill string 29 may be received. Included therein is an annular slip bowl 130. The slip bowl includes a central substantially circular opening 132 through which drill string 29 may be received. A tapered surface 134 is formed about the circumference of the opening and cooperates with a set of conventional slips (not shown) for wedging the drill string in the opening and thereby supporting the same.

An annular packer housing 136 is threadably engaged with slip bowl 130 via threaded connection 138. Included in the packer housing is an inflatable packer assembly, such being indicated generally at 140. Assembly 140 includes an annular lower anchor ring 142 and an annular upper anchor ring 144, such being threadably engaged to one another at threaded connection 146. The anchor rings cooperate with a bladder support ring 148 to define an upper annular space in which a first steel ring 150 is received, and a lower annular space in which a second steel ring 152 is received.

Assembly 140 further includes a first layer 154 of flexible cables, such being made of steel, nylon, or fiber sold under the trademark KEVLAR. A second layer 156 of cable is formed over the first layer and is composed of the same material as first layer 154. Layer 154 is wrapped in a 15° spiral with respect to the center line of bladder support ring 148. The second layer is wrapped in an opposing 15° spiral. The ends of the cables forming layers 154, 156 are wrapped around rings 150, 152 and are secured in the position shown with cement (not shown) injected into the upper and lower annular spaces via ports 158, 160, respectively.

An annular inflatable bladder 162 having an annular air space 164 formed therein is received between layers 154, 156 and bladder support ring 148. A bore 166, in bladder 162 includes a fitting (not shown) received therein for permitting fluid communication between air space 164 and a radial port 168 formed in ring 148. An annular groove 170 is formed on the radially outer surface of ring 148 about the circumference thereof. A plurality of radial ports, one of which is port 172, are formed about the circumference of lower anchor ring 142 to permit fluid communication between annular groove 170 and a radial packer inflation port 174 formed in packer housing 136.

A radially inner bladder 176 is received over layers 154, 156 and has its upper end secured between the lower surface of slip bowl 130 and an upper surface of anchor ring 144. The lower end of bladder 176 is secured between an annular shoulder 178 formed on packer housing 136 and a lower surface of anchor ring 142.

Packer housing 136 further includes a radial circulation port 180 having a threaded radially outer portion.

Figure 3A:
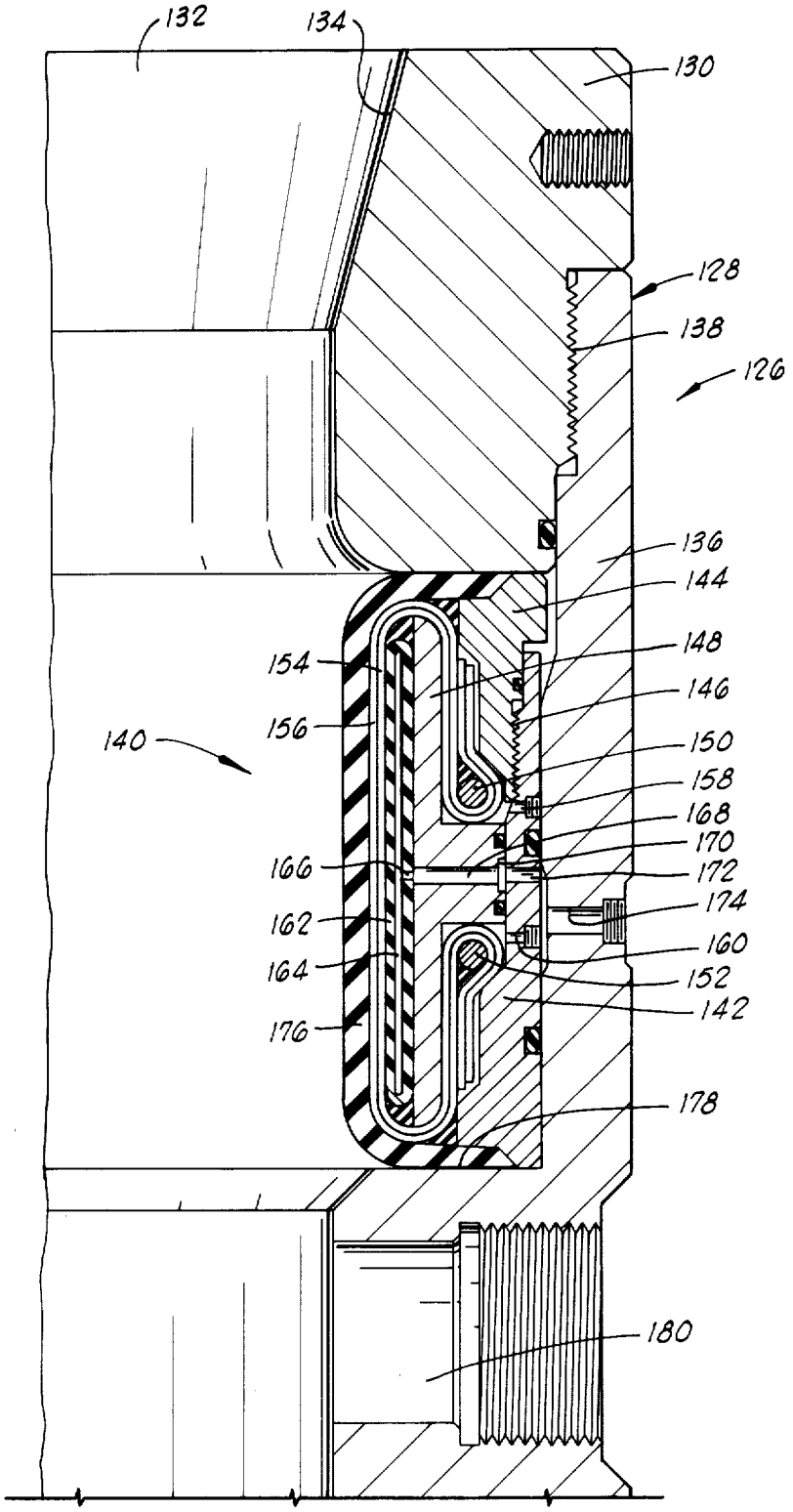
FIGS. 3A-3E are successive downward continuations of a cross-sectional view of the right portion of a second embodiment of a surface packer constructed in accordance with the instant invention.
Figure 3B:
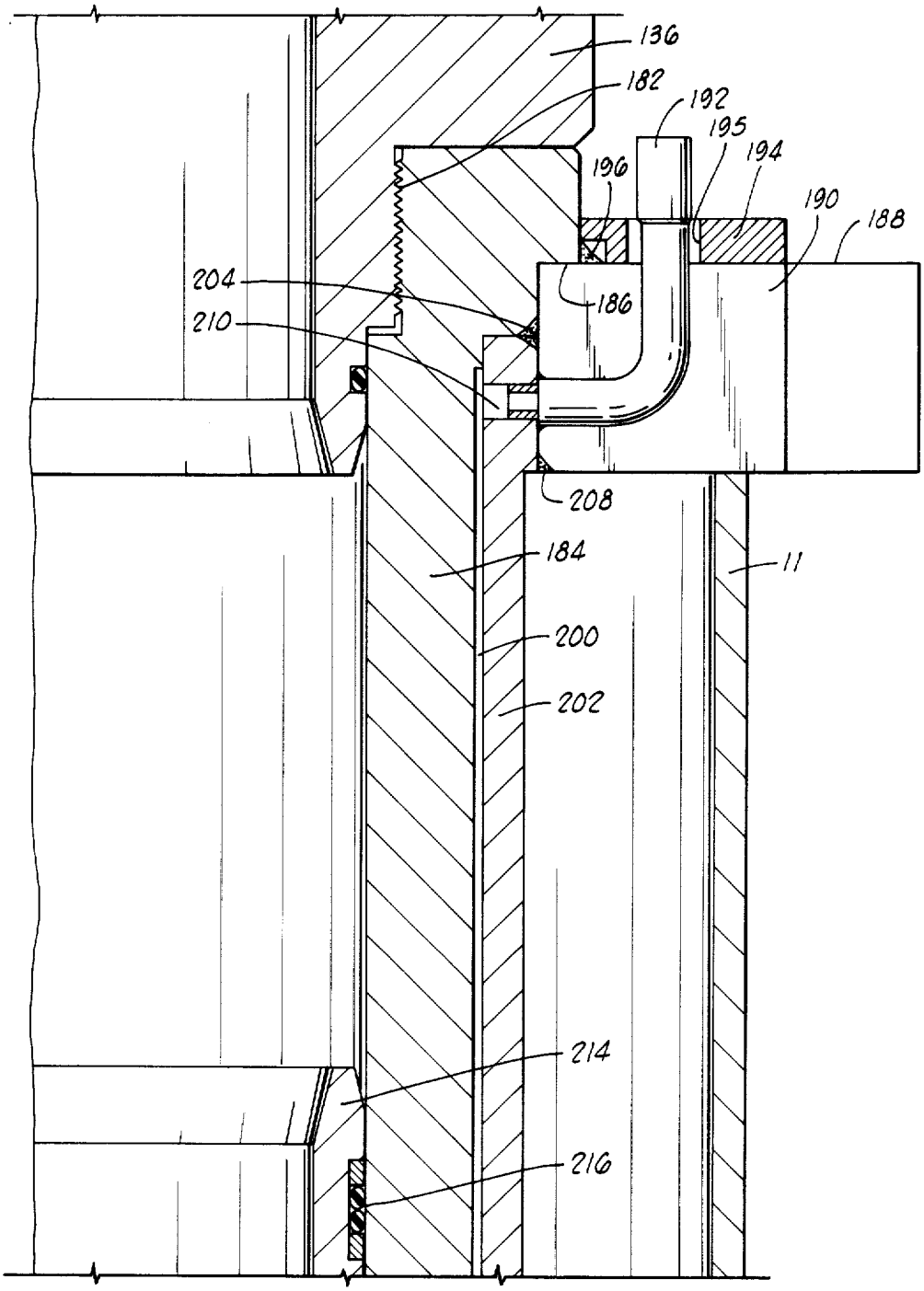

In FIG. 3B, the lower end of packer housing 136 is connected via threaded connection 182 to a substantially tubular piston housing 184. Housing 184 includes a downward-facing annular shoulder 186 formed about the radially outer circumference thereof An annular ring or flange 188 is closely received over housing 184 and abuts the underside of shoulder 186. Flange 188 includes a radial slot 190 formed therein to accomodate a tubular fitting 192. A fitting protection plate 194 is secured to the upper side of flange 188 and includes a bore 195 therethrough to accomodate fitting 192. The flange is welded to piston housing 184 via weld 196.

Housing 184 includes an arcuate slot 200 which is milled on a portion of the radially outer surface thereof. An arcuate plate 202 is welded to the radially outer surface of housing 184 via weld 204, at the upper end of plate 202, and weld 206 at the lower end thereof. Thus, slot 200 defines an arcuate space between housing 184 and plate 202. Another weld 208 is formed between flange 188 and plate 202 at the bottom of the flange.

Plate 202 includes a radial bore 210 at the upper end thereof which permits fluid communication between slot 200 and tubular fitting 192.

Figure 3C:
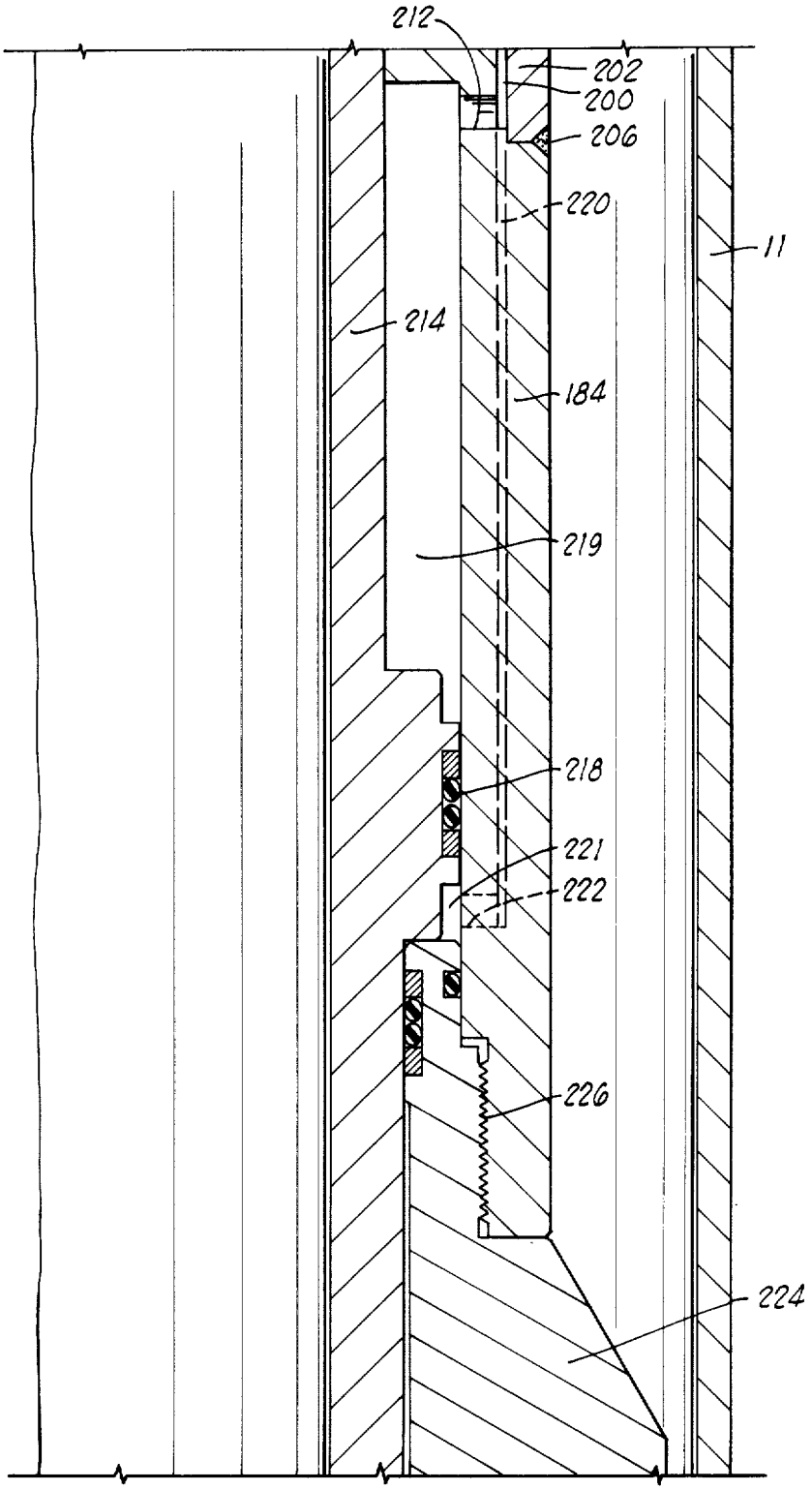

In FIG. 3C, adjacent the lower end of plate 202, a radial bore 212 is formed in piston housing 184 to permit fluid communication between slot 200 and the interior of housing 184. A substantially tubular piston 214, the upper end of which is viewable in the lower portion of FIG. 3B, is received within piston housing 184 and is sealed to the radially inner surface thereof by seals 216, in FIG. 3B, and seals 218, in FIG. 3C. An annular space 219 is defined between the radially outer surface of piston 214 and the radially inner surface of piston housing 184 above seals 218. A second annular space 221 is defined between the radially outer surface of piston 214 and the radially inner surface of piston housing 184 below seals 218.

It can be seen that hydraulic fluid introduced into fitting 192 is communicated via bore 210, slot 200, and bore 212 to space 219 thereby urging piston 214 downwardly.

A fitting (not visible), similar to fitting 192, is mounted on the radially outer surface of an arcuate plate (not visible), like plate 202, which is radially spaced about the circumference of packer 126 from fitting 192. A slot 220, the lower end of which is depicted in dashed lines in FIG. 3C, extends from the fitting to annular space 221 via a bore 222, which permits fluid communication between slot 220 and space 221. Thus, introduction of hydraulic fluid under pressure into the other fitting urges piston 214 upwardly.

The lower end of housing 184 is attached to an annular slip supporting member 224 via threaded connection 226. A set of slips, one of which is slip 228, is connected to slip supporting member 224 in a manner which permits radially inward and outward movement of the slips. The slips are disposed about the circumference of supporting member 224 and each slip includes a plurality of pointed elements indicated generally at 230 on slip 228 which, as will later be more fully explained, may engage the radially inner surface of casing 11 in order to anchor the packer in place.

Figure 3D:
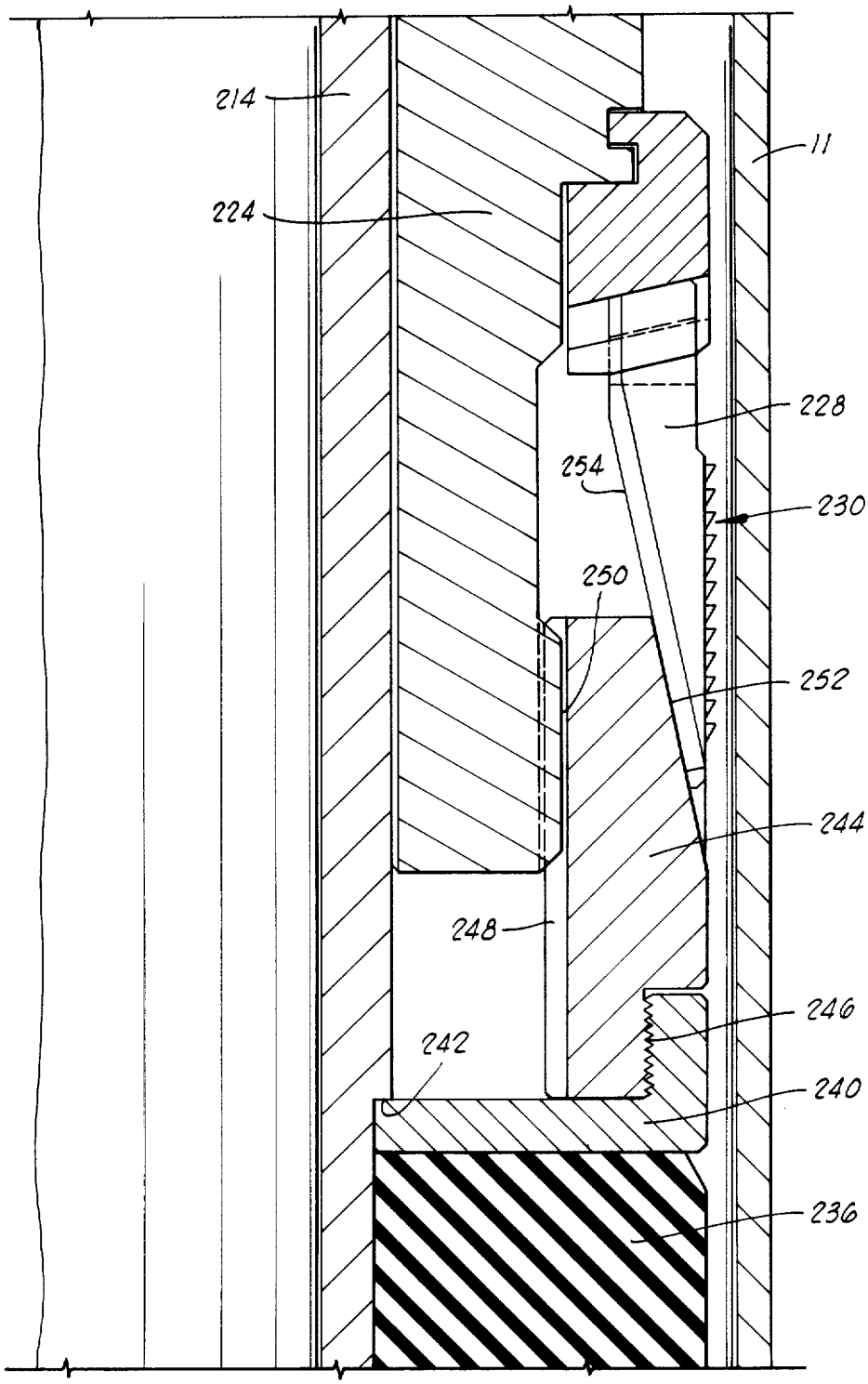
Figure 3E:
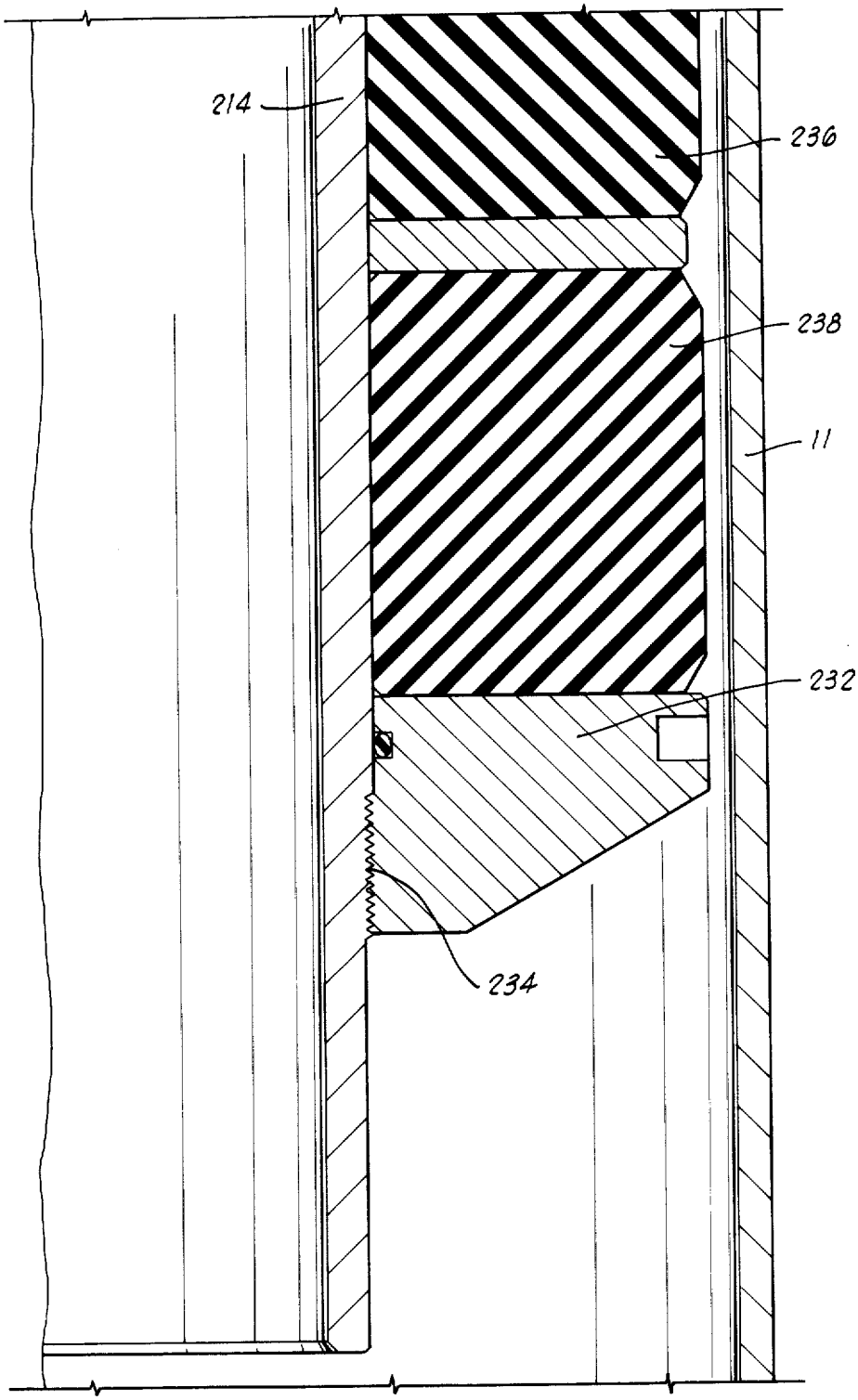

In FIG. 3E, the lower end of piston 214 includes an annular lower packer shoe 232, such being threadably engaged with piston 214 via threaded connection 234. A pair of annular elastomeric packer elements 236, 238 are closely received about piston 214 and are supported by lower packer shoe 232. In FIG. 3D, an annular ring 240 is received beneath a downward facing shoulder 242 formed on the radially outer surface of piston 214. Ring 240 is attached to a substantially annular slip body 244 via threaded connection 246. The slip body includes a first arcuate surface 248 which is abutted against an arcuate surface 250 on member 224 with surface 248 being longitudinally slidable along surface 250.

In a similar fashion, a surface 252 formed on the radially outer surface of slip body 244 is slidable against surface 254 formed on the radially inner surface of slip 228. Thus, it can be seen that when piston 214 is urged upwardly, slip body 244 slides upwardly relative to slip supporting member 224 and slip 228 thereby urging the slip, and each of the other slips, radially outwardly until the pointed elements, like elements 230, engage the radially inner surface of casing string 11 and thus anchor the surface packer thereto. Thereafter, further upward movement of piston 214 compresses packer elements 236, 238 between lower packer shoe 232 and ring 240 thereby deforming the packer elements into sealing engagement with the radially inner surface of the casing.

As was the case in the description of the operation of the embodiment of FIGS. 2A–2C, description of the operation of surface packer 126 in FIGS. 3A–3E will be made in connection with a casing cementing operation; although, as previously mentioned, the surface packer of the invention is not necessarily limited for use in connection with cementing operations. Casing string 11 is first placed in the configuration of FIG. 1 as previously described. Then surface packer 126 is lowered into the upper end of the casing string until flange 188 abuts against the uppermost portion of casing string 11 as shown in FIG. 3B. The flange prevents further lowering of the tool into the casing string and supports the tool in the position of FIGS. 3A–3E.

Then, hydraulic fluid under pressure is introduced into the fitting (not visible), like fitting 192 which provides fluid communicatin with slot 220 and bore 222.

Thus, the pressurized fluid is ultimately provided to annular space 221 thereby urging piston 214 upwardly.

Such upward movement urges shoe 232, in FIG. 3E, packer elements 236, 238, and slip body 244 upwardly thereby urging the slips, like slip 228, radially outwardly. Such upward movement continues until the slips engage the radially inner surface of casing string 11 thereby preventing further upward movement of slip body 244. As hydraulic fluid is further injected into annular space 221, piston 214 continues moving upwardly. Since slip body 244, and therefore ring 240, cannot move further upwardly, packing elements 236, 238 are compressed between shoe 232 and ring 240 thereby deforming the same into sealing engagement with the radially inner surface of casing string 11.

After the packing elements are sealed in the casing as described above, drill pipe string 29, in FIG. 1, is made up with adapter 36 on the lower end thereof and is lowered into casing string 11 through surface packer 126 as described in connection with the description of the operation of surface packer 24.

Surface packer 126 presents an advantage over surface packer 24 in that the distance between flange 188 to the top of slip bowl 130 is less than the distance between flange 88 to the top of slip bowl 48 in surface packer 24. This shortened distance permits the use of conventional drilling rig tongs, which are provided on most drilling rigs, to make up and disconnect pipe joints in drill pipe string 29. The upper end of the vertical range of travel of the rig tongs is limited and therefore the top of the slip bowl must be at a height which is low enough to permit positioning of the rig tongs to make and disconnect the pipe joints that are lowered into and removed from the surface packer through the slip bowl. Surface packer 126 is constructed so that the slip bowl may be positioned at a level which allows use of the rig tongs.

Drill string 29 is made up and lowered until adapter 36 is received within sealing sleeve 40. Thereafter, pressurized hydrulic fluid is introduced into port 174 in FIG. 3A, thereby providing fluid through port 172, port 168 and bore 166 and into space 164 thereby inflating bladder 162. The bias winding of layers of 154, 156 permits expansion of bladder 162 thereby urging bladder 176 radially inwardly into sealing engagement with pipe string 29.

Thereafter, pressurized fluid is injected via port 180 into the annulus between pipe string 29 and the casing thereby maintaining the same under pressure. Next, cement slurry is pumped into pipe string 29 at the upper end thereof. The slurry passes downwardly through check valve 43 and into the annulus between the casing and bore 20. Once the casing-bore annulus is filled with cement and the cement in the drill pipe is circulated out as previously described, the pressure applied to the hydraulic fluid through port 174 is released thereby releasing the seal between bladder 176 and pipe string 29.

Drill string 29 is then removed from the casing as described in connection with the description of the operation of surface packer 24.

Then, hydraulic fluid is introduced into fitting 192, in FIG. 2B, thereby pressurizing annular space 219 which urges the piston downwardly and releases the slips and packing elements 236, 238. Surface packer 126 is in the configuration of FIGS. 3A–3E and may be removed from the uppermost end of the casing string. Thereafter, the upper end of casing string 11 is cut off at the surface and a conventional blowout preventer may be mounted beneath platform 12 and additional drilling or other operations may continue.

Figure 4A:
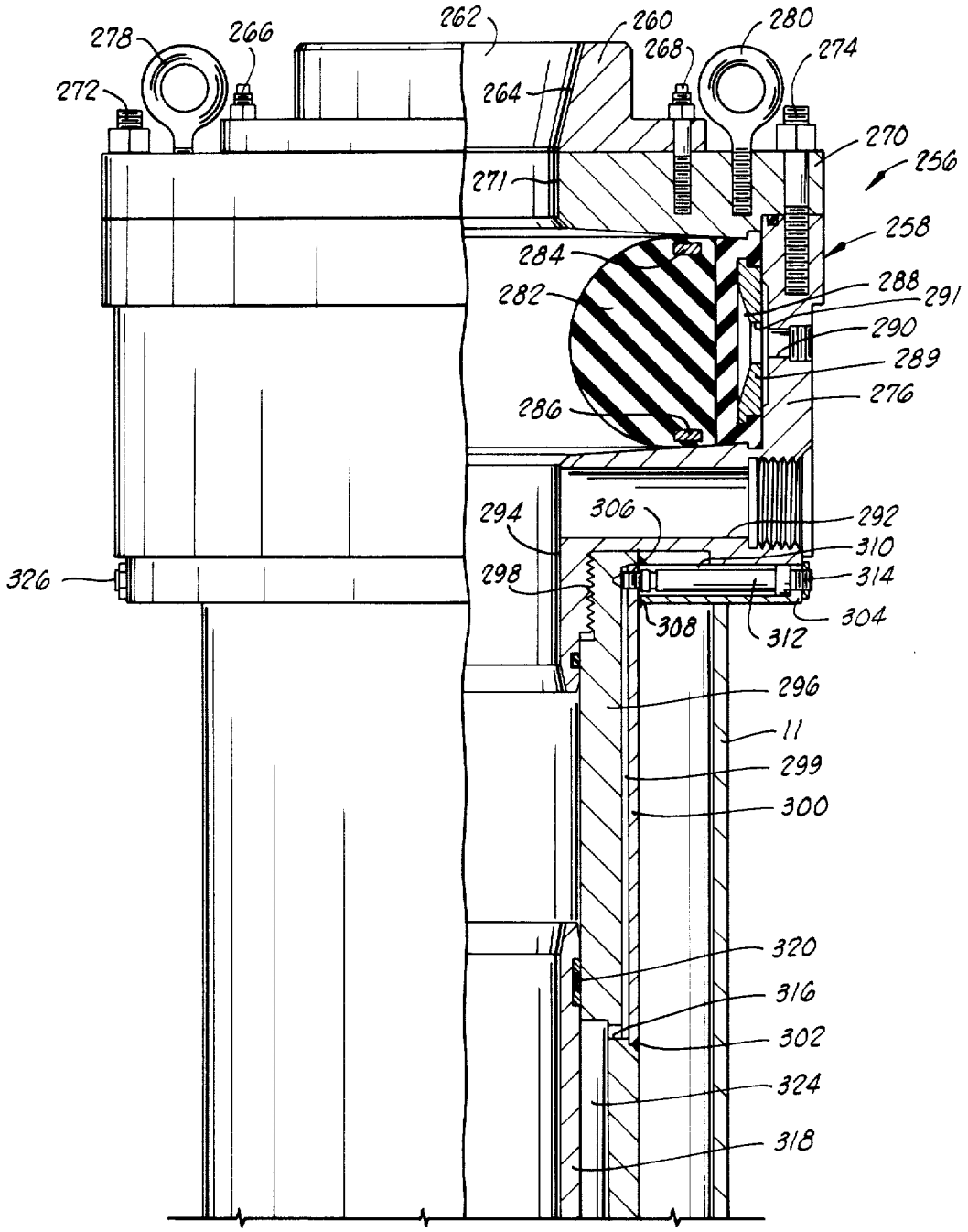
FIGS. 4A-4B are successive downward continuations of a quarter-sectional view of a third embodiment of a surface packer constructed in accordance with the instant invention.
Figure 4B:
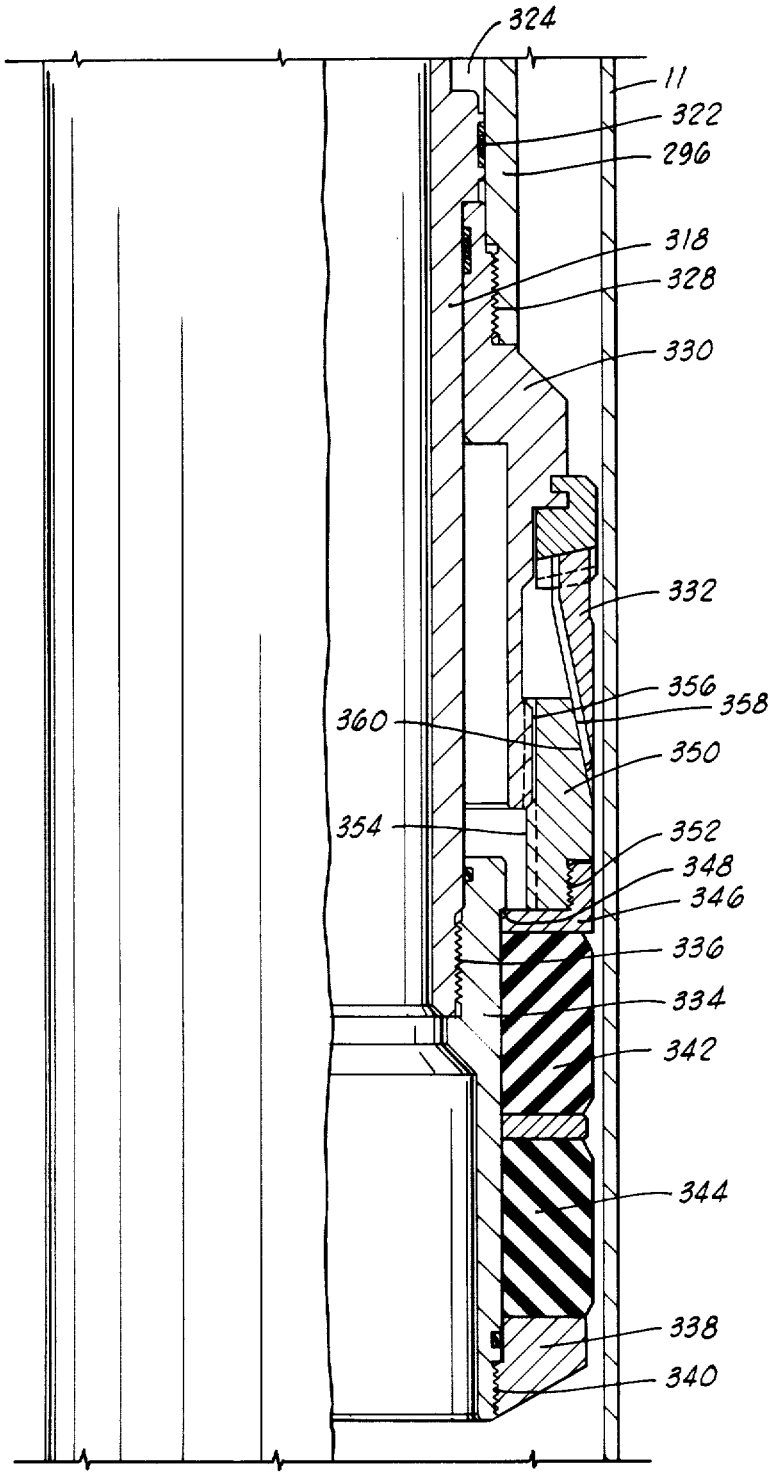

Embodiment of FIGS. 4A–4B

Indicated generally at 256 is a third embodiment of a surface packer constructed in accordance with the apparatus of the instant invention. Surface packer 256 is shown received in the upper end of casing string 11 in the same configuration as surface packer 24 in FIG. 1; however, in the view of FIGS. 4A and 4B, for the sake of clarity, drill pipe string 29 is not shown.

Surface packer 256 includes an elongate annular body 258 extending from the top to the bottom of the surface packer and through which drill pipe string 29 may be received. Included therein is an annular slip bowl 260. The slip bowl includes a central substantially circular opening 262 through which pipe string 29 may be received. A tapered surface 264 is formed about the circumference of the opening and cooperates with a set of conventional slips (not shown) for wedging the drill pipe string in the opening and thereby supporting the same. Bolts 266, 268 secure slip bowl 260 to a packer housing top plate 270. Plate 270 includes therein a circular opening 271, such being substantially coaxial with opening 262 in slip bowl 260. Plate 270 is secured via bolts 272, 274 to an annular packer housing 276. A pair of eye bolts 278, 280 are threadably engaged with plate 270 to provide means for lifting packer 256 with line or cable.

Packer housing 276 has received therein an annular elastomeric packer element 282. The packer element includes a pair of metal rings 284, 286 embedded therein as shown. An annular cavity 288 is formed between the rear of packer element 282 and an annular inflation shoe 289. Cavity 288 is in fluid communication, via bore 291 in shoe 289, with an inflation port 290, such having a threaded radially outer portion for receiving a fitting (not shown) therein.

Housing 276 further includes a radial circulation port 292 having a threaded radially outer portion for engagement with a fitting (not shown). Port 292 permits fluid communication between the fitting and the interior of the packer housing. A cylindrical bore 294 is formed in the lower portion of the packer housing and is substantially coaxial with opening 271 in plate 270.

Packer housing 276 is threadably connected to a piston housing 296 via threaded connection 298. Housing 296 includes an arcuate slot 299 milled on a portion of the radially outer surface thereof. An arcuate plate 300 is welded to the radially outer surface of housing 296 via a lower weld 302 and an upper weld (not visible). Thus, slot 299 comprises an arcuate space defined between housing 296 and plate 300.

An annular plate 304 is welded to the radially outer surface of housing 296 and to plate 300 via welds 306, 308, respectively. A radial slot 310 is milled in the upper surface of plate 304 and has a hose 312 received therein. The radially outer end of hose 312 is connected to a fitting 314 which is received in a bore formed between the radially outer surface of plate 304 and slot 310. The radially inner end of hose 312 is connected to a fitting as shown which permits fluid communication between hose 312 and slot 299.

The lower end of slot 299 is adjacent a radial bore 316 formed in housing 296 which permits fluid communication between slot 299 and the interior of the housing.

A substantially tubular piston 318 is received within piston housing 296 and is sealed against the radially inner surface thereof via seals 320 and seals 322, in FIG. 4B. An annular space 324 is defined between the piston housing and the piston. It can be seen that introduction of hydraulic fluid under pressure into hose 312 via fitting 314 is communicated with space 324 and thereby urges piston 318 downwardly.

A fitting 326, a portion of which is visible in FIG. 4A is mounted on plate 304 in the same fashion as fitting 314. Although not visible, fitting 326 communicates with a hose, like hose 312 which in turn is connected to an arcuate space, like slot 299. The main difference between fitting 326 and its associated hose and arcuate space is that the arcuate space with which fitting 326 communicates extends downwardly further than slot 299. The other arcuate space extends to a point beneath seals 322 and communicates with a radial bore (not visible), similar to bore 316, formed in piston housing 296. The other radial bore is formed in the piston housing beneath seal 322 and thus introduction of hydraulic fluid under pressure into fitting 326 tends to urge piston 318 upwardly.

The lower end of piston housing 296 is attached, via threaded connection 328, to an annular slip supporting member 330 which is closely received about the circumference of piston 318. A set of slips, one of which is slip 332, are connected to slip supporting member 330 in a manner which permits radially outward movement of each of the slips. The slips are disposed about the circumference of supporting member 330 and each slip includes a plurality of pointed elements (not shown) which face the interior of casing 11 and which are engagable therewith in order to anchor the surface packer in place.

The lower end of piston 318 is attached to a packer element mandrel 334 via threaded connection 336. A lower packer shoe 338 is attached to mandrel 334 via threaded connection 340. A pair of annular elastomeric packer elements 342, 344 are closely received about mandrel 334 and are supported by a lower packer shoe 338. A ring 346 is received beneath a downward facing shoulder 348 formed on the radially outer surface. of mandrel 334. A substantially annular slip body 350 is threadably engaged to ring 346 via threaded connection 352. The slip body includes a first arcuate surface 354 which is longitudinally slidable along an arcuate surface 356 on member 330.

In a similar fashion, surface 358 formed on the radially outer surface of slip body 350 is slidable against a surface 360 formed on the inner surface of slip 332. Thus it can be seen that when piston 318 is urged upwardly, slip body 350 slides upwardly relative to slip supporting member 330 and slip 332 thereby urging the slip, and each of the other slips, radially outwardly until they engage the radially inner surface of casing 11 and thus anchor the surface packer thereto. Thereafter, further upward movement of piston 318 compresses packer elements 342, 344 between lower packer shoe 338 and ring 346 thereby deforming the packer elements into sealing engagement with the radially inner surface of the casing.

As was the case in describing the operation of the embodiments of FIGS. 2A–2C and FIGS. 3A–3E, the operation of surface packer 256 in FIGS. 4A–4B will be made in connection with a casing cementing operation. As noted, the surface packer of the invention is not limited for use in connection with cementing operations. Casing string 11 is first placed in the configuration of FIG. 1 as previously described. Then, surface packer 256 is lowered into the upper end of the casing string until the underside of plate 304 abuts against the uppermost portion of casing string 11 as shown in FIG. 4A. The plate prevents further lowering of the tool into the casing string and supports the tool in the position of FIGS. 4A–4B.

Then, hydraulic fluid under pressure is introduced into fitting 326 which is in communication with annular space 324 beneath seals 322. Providing pressurized fluid to fitting 326 thus urges piston 318 upwardly.

Such upward movement urges shoe 338, in FIG. 4B, packer elements 342, 344, and slip body 350 upwardly thereby urging the slips, like slip 332, radially outwardly. Such upward movement continues until all slips engage the radially inner surface of casing string 11 thereby preventing further upward movement of slip body 350. As hydraulic fluid is further injected into annular space 324 beneath seals 322, piston 318 continues moving upwardly. Since slip body 350, and therefor ring 346, cannot move further upwardly, packing elements 342, 344 are compressed between shoe 338 and ring 346 thereby deforming the same into sealing engagement with the radially inner surface of casing string 11.

After the packing elements are sealed in the casing as described above, drill pipe string 29, in FIG. 1, is made up with adapter 36 on the lower end thereof and is lowered into casing string 11 through surface packer 256 as described in connection with the description of the operation of surface packer 24.

Like surface packer 126, surface packer 256 is designed so that the overall distance between the lower side of plate 304, which rests upon the upper end of casing string 11, and slip bowl 260 is sufficiently short to permit use of the drilling rig tongs to assist in running the drill pipe string.

Figure 5:
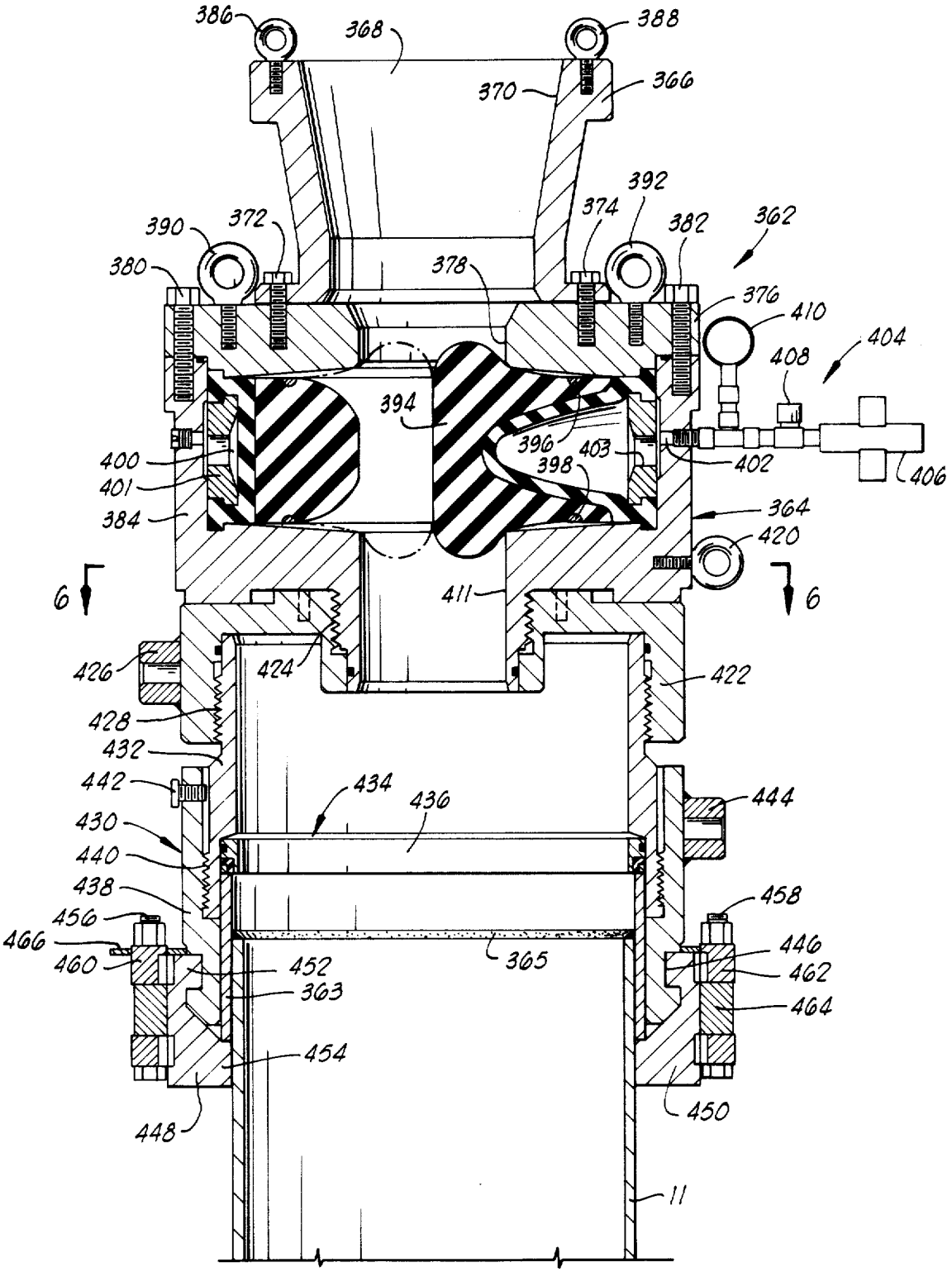
FIG. 5 is a cross-sectional view of a fourth embodiment of a surface packer constructed in accordance with the instant invention with the right half of the packer element shown in inflated condition and a dot-dash line showing the outline of the left half of the packer element in inflated condition.
Figure 8:
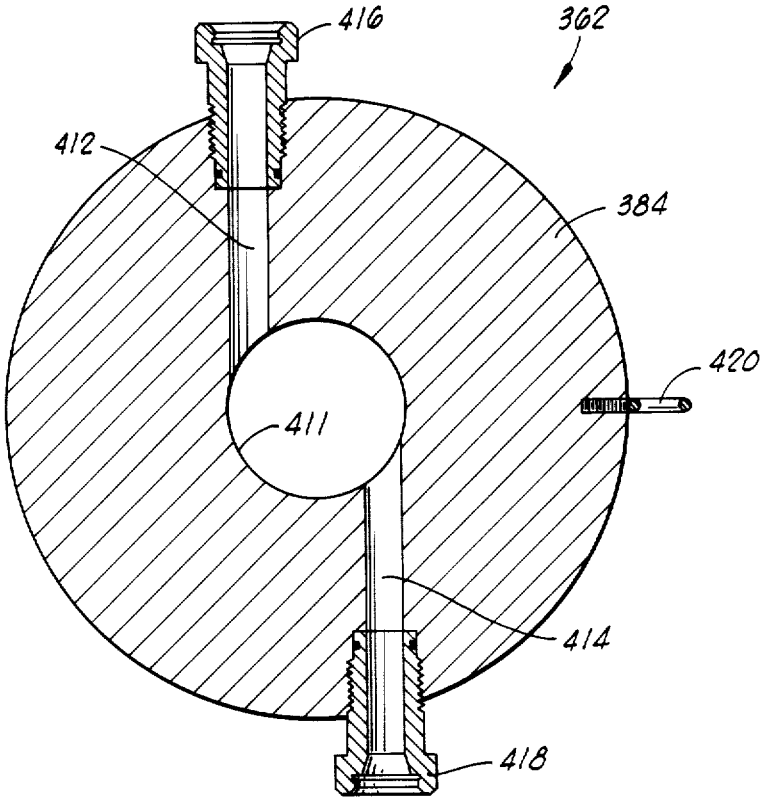

Drill string 29 is made up and lowered until adapter 36 is received within sealing sleeve 40. Thereafter, pressurized hydraulic fluid is introduced into port 290, in FIG. 4A, thereby pressurizing annular cavity 288 and inflating packer element 282. A similar packer element, shown in the embodiment of FIG. 5, is shown in its inflated condition (with the left half inflated position being in dashed lines). Thus, it can be seen when packer element 282 is inflated, the packer seals tightly about the circumference of drill string 29. When no pipe string is present, the packer element seals upon itself as shown in FIG. 5.

Thereafter, pressurized fluid is injected, via circulation port 292, into the annulus between pipe string 29 and the casing thereby maintaining the same under pressure. Next, cement slurry is pumped into pipe string 29 at the upper end thereof. The slurry passes downwardly through check valve 43 and into the annulus between the casing and bore 20.

It should be noted that in certain cementing operations, such as those described in U.S. Pat. No. 4,286,658 (assigned to the assignee of the instant application) and known as full opening cementing equipment and methods, it is necessary to vertically move the inner string, like drill pipe string 29, during the cementing process. If casing string 11 is unusually long and/or is of a large diameter, pressurization of the pipe string-casing annulus during cementing may be necessary for the reasons previously stated. The embodiment of surface packer 256 permits vertical manipulation of drill pipe string 29 during cementing operations while maintaining the annulus between the pipe string and the casing under pressure. Rotational movement may also occur to permit manipulation of other downhole tools without loss of pressure.

As can be seen in FIG. 4A, when packer element 282 is inflated, there is a substantial vertical length of packer 282 which is forced against the radially outer surface of pipe string 29. Thus, as the drill pipe string is raised or lowered, the packer element may break its seal slightly along the upper or lower portions thereof but will maintain the seal along other portions. The sealing action is such that pipe joints, like joint 34 in FIG. 1, may be pulled through the seal formed by packer element 282 without breaking the seal.

Once the casing-bore annulus is filled with cement, the pressure applied to the hydraulic fluid via inflation port 290 may be released thereby releasing the seal between packer element 282 and pipe string 29.

Thereafter, drill string 29 may be removed from the casing as described in connection with the description of the operation of surface packer 24.

Then, hydraulic fluid is introduced into fitting 314, in FIG. 4A, thereby pressurizing annular space 324 above seals 322 on piston 318 which urges the piston downwardly and releases the slips and packing elements 342, 344. Surface packer 256 is in the configuration of 4A-4B and may be removed from the uppermost end of the casing string. The upper end of casing string 11 is next cut off at the surface and aconventional blowout preventor is mounted beneath platform 12 and additional drilling or other operations may continue.

It should be noted that surface packer 256 may be adapted for use in casing strings of diameters different from that of casing string 11 by unthreading threaded connection 298 which connects piston housing 196 to packer housing 276. A different piston housing having all the components which are attached to and associated with housing 296, but sized for different-sized casing, may then be threadably engaged to packer housing 276 at the same place which piston housing 296 is threadably engaged with the packer housing.

It is to be appreciated that pipe strings of varying sizes may be accomodated by surface packer 256 because packer element 282 inflates for sealing against whatever diameter pipe is presented. In fact, as shown in FIG. 4A, packer element 282 may be inflated to provide a seal without any pipe received in the surface packer.

Embodiment of FIGS. 5 and 6

Indicated generally at 362 is a fourth embodiment of a surface packer constructed in accordance with the apparatus of the instant invention. Surface packer 362 is shown mounted on the upper end of casing string 11 in a configuration similar to that of surface packer 24 in FIG. 1; however, in the view of FIGS. 5 and 6, for the sake of clarity, drill pipe string 29 is not shown.

Unlike the previously-disclosed embodiments, surface packer 362 is mounted on casing string 11 in conjunction with a cylindrical coupling 363. Coupling 363 is closely received over the upper end of casing string 11 and is welded thereto about the circumference of each by a weld 365. The manner in which surface packer 362 cooperates with casing string 11 and coupling 363 will be hereinafter more fully described.

Surface packer 362 includes an elongate annular body 364 extending from the top to the bottom of the surface packer and through which drill pipe string 29 may be received. Included therein is an annular slip bowl 366. The slip bowl includes a central substantially circular opening 368 through which pipe string 29 may be received. A tapered surface 370 is formed about the circumference of the opening and cooperates with a set of conventional slips (not shown) for wedging the drill pipe string in the opening and thereby supporting the same. Screws 372, 374 secure slip bowl 366 to a packer bowl cap 376. Cap 376 includes therein a circular opening 378, such being substantially coaxial with opening 368 in slip bowl 366. Cap 376 is secured via screws 380, 382 to an annular packer bowl 384. A pair of eye bolts 386, 388 is mounted on the upper portion of slip bowl 366 to provide means for lifting the slip bowl with line or cable. A second pair of eye bolts 390, 392 is mounted on the upper portion of packer bowl cap 376 to provide means for lifting packer 362 with line or cable.

Packer bowl 384 has received therein an annular elastomeric packer element 394. The packer element includes a pair of metal rings 396, 398 embedded therein as shown. An annular cavity 400 is formed between the rear of packer element 394 and an annular inflation shoe 401. The inflation shoe anchors the radially outer upper and lower portions of packer element 394 against the radially inner surface of packer bowl 384. Cavity 400 is in fluid communication, via bore 403 in shoe 401, with an inflation port 402. In FIG. 5, the right half of packer element 394 is shown in its inflated condition and the left half in its uninflated condition The outline of the left half in its inflated condition is indicated by a dot-dash line.

A fitting, indicated generally at 404 is threadably engaged with inflation port 402. The fitting includes therein a quick-disconnect coupling 406, a needle valve 408 and a pressure gauge 410 to indicate the pressure in the fitting and thus the packer inflation pressure in cavity 400.

Packer bowl 384 includes a cylindrical bore 411 formed in the lower portion of the packer bowl. Bore 411 is substantially coaxial with opening 378 in packer bowl cap 376. Communicating with bore 411, visible in FIG. 6, are a pair of circulation ports 412, 414 which are each in communication with fittings 416, 418, respectively, mounted on the radially outer surface packer 362. An eye bolt 420 is provided for lifting and guiding the surface packer and is viewable in both FIGS. 5 and 6.

An annular adapter 422 is mounted on the lower end of packer bowl 384 via threaded connection 424. The adapter includes a hammer lug 426 welded on a radially outer surface thereof to facilitate rotation of adapter 422 relative to other packer parts in the assembly and disassembly thereof.

Adapter 422 is engaged via threaded connection 428 to a tubular connecting device, such being designated generally by the numeral 430. The tubular connecting device is substantially the same as that disclosed in U.S. Pat. No. 4,524,998 and assigned to the assignee of the instant application.

Included in connecting device 430 is an annular body 432. Body 432 is connected, via threaded connection 428, to adapter 422 at the upper end of the body.

An annular seal 434 is closely received against a radially inner surface of body 432 and includes an annular seal carrier ring 436. The seal carrier ring has annular grooves formed therein into which are received various seals and an antiextrusion ring as shown.

An annular adjusting nut 438 is engaged via threaded connection 440 to the lower end of body 432. A locking screw 442 is threadably received in a radial bore in nut 438. The locking screw may be tightened against the radially outer surface of body 432 in order to fix the relative rotational positions of the body and the adjusting nut. A hammer lug 444 is mounted on the radially outer surface of adjusting nut 438 and serves the same purpose as hammer lug 426.

Adjusting nut 438 includes an annular groove 446 formed in the radially outer surface thereof. The lower portion of the adjusting nut is closely received over coupling 363.

First and second arcuate collar portions 448, 450 are received over adjusting nut 438 and casing string 11. Each of the collar portions is substantially semi-circular in shape and includes an upper lip, like lip 452 on collar portion 448 and a lower lip, like lip 454 on collar portion 448. The upper lip of each arcuate collar portion is received in groove 446 while the radially inner surface of the lower lip is abutted against the radially outer surface of casing string 11 beneath coupling 363. Arcuate collar portions 448, 450 are pinned into position as shown via pins 456, 458 received in pin sleeves 460, 462 which are mounted on the collar portions. Each of the pins is received through an arcuate latch arm 464 which holds the collar portions in position as shown. A limit ring 466 is received over adjusting nut 438 and limits the extent to which collar portions 448, 450 may be hinged open as explained in U.S. Pat. No. 4,524,998.

As was the case in describing the operation of the previously-disclosed embodiments herein, description of the operation of surface packer 362 will be made in connection with a casing cementing operation. As noted, the surface packer of the invention is not limited for use in connection with cementing operations. Casing string 11 is first placed in the configuration of FIG. 1 as previously described. Coupling 363 is slipped over the upper end of the casing and welded around a radially inner surface thereof to the upper end of casing string 11 via weld 365.

Next, surface packer 362 is fitted over the upper end of coupling 363 until seal 434 abuts against the upper end of the coupling. It should be noted that a conventional casing collar, like casing collar 22 in FIG. 1, may be used instead of welding coupling 363 on the upper end of the casing string. The casing collar may be used in cases where the upper end of the top casing pipe of casing string 11 is at the appropriate height over platform 12. In other cases, the casing may be cut and coupling 363 welded into place as shown in FIG. 5.

Next, collar portions 448, 450 and latch arm 464 are placed in the position as shown in FIG. 5 and pins 456, 458 are inserted in pin sleeves 460, 462 and latch arm 464 thereby fixing collar portions 458, 450 in the position of FIG. 5.

The initial compression of the seals carried by seal carrier ring 436 is adjusted by increasing threaded connection 440 between adjusting nut 438 and body 432. Thereafter, the relative rotational positions of the adjusting nut and the body are set by tightening locking screw 442 against the body.

Once surface packer 362 is suitably mounted on and sealed to casing string 11, drill string 29 is made up and lowered until adapter 36 is received within sealing sleeve 40, in FIG. 1. Thereafter, a conventional quick-connect coupling which is attached to a line from a small air or hand operated hydraulic pump is connected to coupling 406. Hydraulic fluid is pumped, via the pump, into inflation port 402 until an appropriate inflation pressure, such being indicated by gauge 410, is achieved. When the appropriate pressure is indicated on gauge 410, needle valve 408 may be shut and, if desired, the coupling mounted on coupling 406 is removed.

With pipe string 29 received through surface packer 362, and with pressurized hydraulic fluid received in cavity 400, packer element 394 is in sealing engagement about the circumferemce of the drill string.

Next, pressurized fluid is injected, via one of circulation ports 412, 414, into the annulus between pipe string 29 and the casing thereby maintaining the same under pressure. Then, cement slurry is pumped into pipe string 29 at the upper end thereof. The slurry passes downwardly through check valve 43 and into the annulus between the casing and bore 20.

It should be noted that in certain cememting operations, such as those described in U.S. Pat. No. 4,286,658 (assigned to assignee of the instant application) and referred to as full opening cementing equipment and methods, it is necessary to vertically move the inner string, like drill pipe string 29, during the cementing process. Such vertical movement, as well as rotational movement, may be obtained with surface packer 362 without loss of pressure in the annulus between pipe string 29 and casing string 11 as described in connection with the embodiments of FIGS. 4A–4B.

Once the casing-bore annulus is filled with cement, needle valve 408 may be opened thereby releasing the inflation pressure in cavity 400 and thus releasing the seal between packer element 394 and pipe string 29.

Thereafter, drill string 29 may be removed from the casing as described in connection with the description of the operation of surface packer 24.

Surface packer 362 is then removed from casing string 11 by unthreading locking screw 442 until it is no longer tight against body 432. Thereafter, threaded connection 438 between adjusting nut 438 and body 432 is unthreaded thereby reducing sealing action of seal 434. Next, pins 456, 458 are removed thereby permitting expansion of collar portions 448, 450 and the surface packer is lifted from the upper end of casing string 11. The upper end of casing string 11 may be cut off at the surface and a conventional blow-out preventer mounted beneath platform 12 and additional drilling or other operations may continue.

It should be noted that surface packer 362 may be adapted for use in casing strings having diameters different from that of casing string 11 by providing tubular connecting devices, like tubular connecting device 430, of varying diameters. For each such connecting device, a different adapter, like adapter 422 is provided. Each adapter has a lower end suitable for threaded engagement with its associated connecting device and an upper end suitable for threaded engagement with the lower end of packer bowl 384.

Thus, it is seen that the apparatus of the present invention readily achieves the ends and advantages mentioned as well as those inherent therein. While certain preferred embodiments of the present invention have been illustrated for the purposes of this disclosure, numerous changes in the arrangement and construction of parts may be made by those skilled in the art, which changes are encompassed within the scope and spirit of this invention as defined by the apended claims.

We claim:

1. A method for sealing a string of casing received in a well bore located beneath a drilling rig platform comprising the steps of:

lowering the string of casing into the bore until the casing extends from substantially the lower end of the bore to a point above the platform;

mounting a packer of the type which may be fluidically set on the upper end of said casing string, said packer being annular in shape and including a circular opening in the center thereof;

setting said packer; and sealing between said packer around the outer circumference thereof and the inner circumference of the upper end of said casing string, said step of sealing comprising the steps of:

mounting said packer on the upper end of an elongate annular body;

lowering said body into the upper end of said casing string; and packing off the space between said body and said casing string.

2. The method of claim 1 wherein said method further includes the steps of:

mounting a slip bowl on the upper end of said casing string above said packer prior to lowering a pipe string into said casing; and using a set of slips in conjunction with said slip bowl to lower said pipe string into said casing.

3. The method of claim 1 wherein said method further includes the step of lowering a string of pipe into said casing string prior to mounting a packer of the type which may be fluidically set on the upper end of said casing string.

4. The method of claim 1 wherein said packer includes an inflatable packer element and wherein the step of setting said packer comprises the step of inflating said packer element.

5. The method of claim 1 wherein said packer includes an elastomeric packer element and wherein the step of setting said packer element comprises the step of urging a setting piston thereaganist.

6. The method of claim 1 wherein said method further includes the step of lowering a string of pipe into said casing string prior to setting said packer.

7. The method of claim 6 wherein said method further includes the step of rotating said pipe string after setting said packer.

8. The method of claim 6 wherein said method further includes the step of vertically moving said pipe string after setting said packer.

9. The method of claim 8 wherein said pipe sring includes a plurality of joints at which individual pipes making up the pipe string are connected and wherein the step of vertically moving said pipe string after setting said packer comprises the step of passing one of said joints through said packer.

10. The method of claim 1 wherein said method further includes the step of anchoring said body to the upper end of said casing string.

11. The method of claim 1 wherein said elongate annular body includes a packing element disposed abut the outer circumference thereof and wherein the step of packing off the space between said body and said casing string comprise the step of setting said packing element.

12. The method of claim 11 wherein said elongate annular body includes a packing element setting piston and wherein the step of setting said packing element comprises the step of introducing hydraulic fluid into said body for urging said piston against said packing element.

13. The method of claim 1 wherein the step of mounting a packer of the type which may be fluidically set on the upper end of said casing string comprises the steps of:

mounting said packer on a coupling device adapted for connection to one end of a piece of casing having a casing collar thereon; and connecting said coupling device to the upper end of said casing string.

14. The method of claim 13 wherein said casing string is suspended from said platform with a set of slips and wherein said method further includes the step of cutting off said casing string above said slips and welding an annular coupling to the upper end of said casing string prior to connecting said coupling device.

15. A method for sealing a string of casing received in a well bore located beneath a drilling rig platform comprising the steps of:

lowering the string of casing into the bore until the casing extends from substantially the lower end of the bore to a point above the platform;

mounting a packer of the type which may be fluidically set on the upper end of said casing string, said step of mounting a packer comprises the steps of:

mounting said packer on the upper end of an elongate annular body;

lowering said body into the upper end of said casing string; and anchoring said body to the upper end of said casing string; and setting said packer.

16. The method of claim 15 wherein said elongate annular body includes a set of slips and the step of anchoring said body to the upper end of said casing string comprises the step of engaging said slips with the radially inner surface of the upper end of said casing string.

17. A method for cementing a casing in a well bore comprising the steps of:

mounting an inflatable packer element on the radially inner surface of an annular body;

lowering a string of casing into the well bore;

mounting said body on the upper end of said casing string, said step of mounting said body comprising the steps of:

lowering said body into the upper end of said casing string; and packing off the the space between said body and said casing string;

lowering a string of pipe into said casing string;

providing means for permitting fluid communication between the interior of said pipe string and the annulus between said casing and said well bore;

inflating said packer element to seal the annulus between said casing string and said pipe string; and pumping cement into said pipe string.

18. The method of claim 17 wherein said method further includes the step of rotating said pipe string after the step of inflating said packer element.

19. The method of claim 17 wherein the step of mounting said body on the upper end of said casing string is performed after the step of lowering a string of pipe into said casing string.

20. The method of claim 17 wherein said method further includes the steps of:

mounting a slip bowl on the upper end of said casing string above said packer element prior to lowering said pipe string into said casing; and using a set of slips in conjunction with said slip bowl to lower said pipe string into said casing.

21. The method of claim 17 wherein the step of mounting an inflatable packer element on the upper end of said casing string comprise the steps of:

mounting said packer element on a coupling device adapted for connection to one end of a piece of casing having a casing collar thereon; and connecting said coupling device to the upper end of said casing string.

22. The method of claim 21 wherein said casing is suspended from said platform with a set of slips and wherein said method further includes the step of cutting off said casing string above said slips and welding an annular coupling to the upper end of said casing string prior to connecting said coupling device.

23. The method of claim 17 wherein said method further includes the steps of vertically moving said pipe string after the step of inflating said packer element.

24. The method of claim 23 wherein said pipe string includes a plurality of joints at which individual pipes making up the pipe string are connected and wherein the step of vertically moving said pipe string after inflating said packer element comprises the step of passing one of said joints through said packer.

25. Apparatus for sealing a well casing at the upper end thereof comprising:

an annular body having a lower end adapted for sealing connection to the upper end of said well casing;

a packer of the type which may be fluidically set mounted on the radially inner surface of said annular body, said packer including:

an elastomeric packer element; and a setting piston adjacent said packer element for setting the same;

a slip bowl mounted on said body over said packer; and means for anchoring said body to said casing.

26. The apparatus of claim 25 wherein said annular body further includes a coupling device at the lower end thereof, said coupling device being adapted for connection to one end of a piece of casing having a casing collar thereon.

27. The apparatus of claim 25 wherein said packer includes an inflatable packer element.

28. The apparatus of claim 25 wherein said packer is annular in shape and includes a circular opening in the center thereof for receiving a pipe string therethrough.

29. The apparatus of claim 25 wherein said anchoring means comprises a set of slips mounted on said body.

30. The apparatus of claim 25 wherein said apparatus further includes a sealing element disposed about the outer surface of said body for sealing the annulus between said casing and said body.

31. The apparatus of claim 30 wherein said apparatus further includes a hydraulcially activated setting piston adjacent said sealing element for setting said sealing element responsive to hydraulic pressure.

32. Apparatus for sealing the annulus between a pipe string and a string of casing in which said pipe string is received comprising:

an elongate annular body receivable in such a string of casing;

a first substantially annular elastomeric sealing element received in said body for receiving such a pipe therethrough;

a second substantially annnular elastomeric sealing element formed about the outer circumference of said elongate annular body for sealing the annulus between said body and said casing string when said body is received therein;

means for suspending said body at the upper end of such casing string; and a slip bowl mounted on said body over said second substantially annular elastomeric sealing element.

33. The apparatus of claim 32 wherein said apparatus includes a slip bowl mounted on said body over said packer.

34. Apparatus for sealing the annulus between a pipe string and a string of casing in which said pipe string is received comprising:

an elongate annular body receivable in such a string of casing;

a first substantially annular elastomeric sealing element received in said body for receiving such a pipe therethrough;

a second substantially annular elastomeric sealing element formed about the outer circumference of said elongate annular body for sealing the annulus between said body and said casing string when said body is received therein; and means for suspending said body at the upper end of such a casing string, said suspending means comprises a downward-facing surface formed on said body for abutting against the upper end of such a casing string.

35. The apparatus of claim 34 wherein said suspending means further comprises a set of slip mounted on said body for providing anchoring engagement with such a casing string.

36. Apparatus for sealing the annulus between a pipe string and a string of casing in which said pipe string is received comprising;

an elongate annular body receivable in such a string of casing;

a first substantially annular elastomeric sealing element received in said body for receiving such a pipe therethrough;

a second substantially annular elastomeric sealing element formed about the outer circumference of said elongate annular body for sealing the annulus between said body and said casing string when said body is received therein.

means for suspending said body at the upper end of such casing string; and first and second setting pistons adjacent said first and second sealing elements for sealing the same responsive to hydraulic pressure.

37. Apparatus for sealing the annulus between a pipe string and a string of casing in which said pipe string is received, said apparatus comprising:

a substantially annular packer having an upper end and lower end, said packer further having an inflatable annular packer element received therein, a body portion, and a cap portion secured to said body portion;

a slip bowl mounted on the upper end of said packer being secured to said cap portion of said packer;

a substantially annular coupling device to be connected to one end of a casing pipe of said string of casing, said coupling device being mounted on the lower end of said packer being secured to said body portion of said packer; and an annuluar adaptor between said body portion of said packer and said coupling device, said adaptor having a set of upper threads for threadably engaging the lower end of said body portion of said packer and a set of lower threads for threadedly engaging the upper end of said connecting device.

38. The apparatus of claim 37 wherein said apparatus further includes a quick-connect hydraulic fitting mountable on said packer for inflating said packer element.

39. The apparatus of claim 37 wherein said apparatus further includes a plurality of adapters, each having an upper threaded end which is connectable to said packer and a different-sized lower threaded end for threadably engaging different-sized connecting devices.

40. The apparatus of claim 37 wherein said coupling device is adapted and constructed to fit over a piece of casing.

41. The apparatus of claim 40 wherein said coupling device is adapted and constructed to connect to one end of a piece of casing having a casing collar thereon.

42. The apparatus of claim 41 wherein said apparatus further includes an annular coupling ring, said ring being mountable on one end of a piece of casing for mounting said coupling device thereon.

* * * * *

UNITED STATES PATENT AND TRADEMARK OFFICE

CERTIFICATE OF CORRECTION

PATENT NO. : 4,718,495

DATED : January 12, 1988

INVENTOR(S) : Eric Lubitz et al.

It is certified that error appears in the above-identified patent and that said Letters Patent is hereby corrected as shown below:

In column 17, line 59, delete the word [abut] and insert therefor --about--.

Signed and Sealed this

Fourteenth Day of June, 1988

*Attest:*

DONALD J. QUIGG

*Attesting Officer*

*Commissioner of Patents and Trademarks*